US008117806B2

(12) United States Patent
Thurgood et al.

(10) Patent No.: US 8,117,806 B2
(45) Date of Patent: Feb. 21, 2012

(54) VERTICAL BAGGING MACHINE

(75) Inventors: Robin G. Thurgood, Marshall, MI (US); Brian C. Bowerman, Quincy, MI (US); Dale R. Vincent, Tekonsha, MI (US)

(73) Assignee: Rennco LLC, Homer, MI (US)

( * ) Notice: Subject to any disclaimer, the term of this patent is extended or adjusted under 35 U.S.C. 154(b) by 0 days.

(21) Appl. No.: 13/198,985

(22) Filed: Aug. 5, 2011

(65) Prior Publication Data

US 2011/0283664 A1 Nov. 24, 2011

Related U.S. Application Data

(63) Continuation of application No. 12/410,784, filed on Mar. 25, 2009, now Pat. No. 7,992,364.

(51) Int. Cl.
*B65B 9/08* (2006.01)

(52) U.S. Cl. ..... 53/451; 53/450; 53/455; 53/456; 53/77; 53/551

(58) Field of Classification Search ..... 53/450, 53/451, 452, 455, 456, 52, 77, 545, 548, 53/550, 551, 552–555
See application file for complete search history.

(56) References Cited

U.S. PATENT DOCUMENTS

| | | | |
|---|---|---|---|
| 2,114,855 | A | 4/1938 | Munson |
| 3,147,674 | A | 9/1964 | Hoeppner |
| 3,575,090 | A | 4/1971 | Hook |
| 3,599,538 | A | 8/1971 | Piazze |
| 3,724,341 | A | 4/1973 | Hook |
| 3,748,205 | A | 7/1973 | Adams |
| 3,791,267 | A | 2/1974 | Brooks |
| 3,889,871 | A | 6/1975 | White |
| 4,138,932 | A | 2/1979 | Mowli et al. |
| 4,362,526 | A | 12/1982 | Wilson |
| 4,464,158 | A | 8/1984 | Kardon |
| 4,581,007 | A | 4/1986 | Kamp |
| 4,704,100 | A | 11/1987 | Kaufman |
| 4,925,438 | A | 5/1990 | Wagner |
| 4,997,416 | A | 3/1991 | Mitchell et al. |
| 5,014,852 | A | 5/1991 | Herrington et al. |
| 5,044,772 | A | 9/1991 | Larson |

(Continued)

OTHER PUBLICATIONS

Thurgood, R., "Vertical Bagging Machines Offer Cost Cutting Opportunities," Rennco LLC (7 pages), Apr. 1, 2009.

(Continued)

*Primary Examiner* — Christopher Harmon
(74) *Attorney, Agent, or Firm* — Thompson Hine LLP

(57) ABSTRACT

A vertical bagging machine including a spindle for receiving and supporting a roll of stock material, the spindle defining a spindle axis, wherein the stock material is unwindable as a sheet, a folding plate defining a folding plate plane that is substantially parallel with the spindle axis, the folding plate including a first edge and a second edge, wherein the first and second edges are generally equal in length and connect at a central peak, a spreader chute including a first guide plate and a second guide plate, the second guide plate being generally parallel with and spaced apart from the first guide plate, wherein the first and second guide plates are substantially perpendicular to the folding plate plane, and first and second folding rollers defining a nip therebetween, the first and second folding rollers being generally parallel with the folding plate plane and disposed between the folding plate and the spreader chute, wherein the sheet is moveable over the central peak, through the nip, and over the first and second guide plates to define a loading space between the first and second guide plates.

13 Claims, 3 Drawing Sheets

U.S. PATENT DOCUMENTS

| | | | |
|---|---|---|---|
| 5,966,900 | A | 10/1999 | Burford et al. |
| 6,263,645 | B1 | 7/2001 | Burford et al. |
| 6,698,166 | B2 | 3/2004 | Zysman |
| 7,194,333 | B2 | 3/2007 | Shoenfeld |
| 7,287,637 | B2 | 10/2007 | Campbell et al. |
| 7,678,035 | B2 | 3/2010 | Jansen |
| 7,768,549 | B2 | 8/2010 | Cofer |
| 2007/0099783 | A1 | 5/2007 | Thurgood et al. |
| 2008/0202070 | A1 | 8/2008 | Gertitschke et al. |

OTHER PUBLICATIONS

Thurgood, R., "Vertical Bagging Machines Improve Sustainability While Cutting Material and Labor Costs," Rennco LLC (3 pages), Apr. 1, 2009.

Official Action, U.S. Appl. No. 11/259,886 (Feb. 23, 2009).

Official Action, U.S. Appl. No. 11/259,866 (Sep. 25, 2007).

Official Action, U.S. Appl. No. 11/259,886 (Jan. 16, 2007).

VERTICAL BAGGING MACHINE

FIELD

The present patent application relates to vertical bagging machines and, more particularly, to vertical bagging machines that utilize rolled, flat (i.e., not pre-folded) film stock material.

BACKGROUND

Bags, particularly bags formed by bagging machines, provide manufacturers and suppliers with an efficient and cost effective means for packaging their goods. As such, various consumer goods are packaged in bags, including food service items (e.g., cups, lids, knives, forks and spoons), do-it-yourself items (e.g., paint rollers, wallpaper rolls, window shades and curtain rods), toys (e.g., footballs), kits (e.g., auto parts, nuts and bolts, puzzle pieces, tie wraps) and various products sold in bulk (e.g., bottle caps).

Manufacturers and suppliers seeking to bag their goods typically have three packaging options. As a first option, premade bags may be filled by hand and then sealed. However, hand packing has obvious disadvantages, including high labor cost and low output speed. As a second option, bags may be filled using a horizontal bagging machine. While horizontal bagging machines offer substantial advantages over hand packing, horizontal bagging machines are generally limited to packaging items that are longer than they are wide on the horizontal axis. In particular, horizontal bagging machines typically are not suited to handle irregular shaped objects. Finally, the third option is a vertical bagging machine.

Vertical bagging machines, like horizontal bagging machines, may be hand loaded or fully automated. Furthermore, vertical bagging machines typically are supplied with film that travels vertically (i.e., normal to the surface of the earth) around and over the product. The film is then cut and sealed to form the bags around the product. As such, vertical bagging machines have a generally small footprint, but can accommodate items of various sizes (e.g., 2 inches by 2 inches to 24 inches by 65 inches) without the need for retooling.

Nonetheless, those skilled in the art continue to seek advances in the field of vertical bagging machines.

SUMMARY

In one aspect, the vertical bagging machine may include a spindle for receiving and supporting a roll of stock material, the spindle defining a spindle axis, wherein the stock material is unwindable from the roll as a sheet, a folding plate defining a folding plate plane that is substantially parallel with the spindle axis, the folding plate including a first edge and a second edge, wherein the first and second edges are generally equal in length and connect at a central peak, a spreader chute including a first guide plate and a second guide plate, the second guide plate being generally parallel with and spaced apart from the first guide plate, wherein the first and second guide plates are substantially perpendicular to the folding plate plane, and first and second folding rollers defining a nip therebetween, the first and second folding rollers being generally parallel with the folding plate plane and disposed between the folding plate and the spreader chute, wherein the sheet is moveable over the central peak, through the nip, and over both the first and second guide plates to define a loading space between the first and second guide plates.

In another aspect, the disclosed vertical bagging machine may include a spindle defining a spindle axis, a roll of stock material received over the spindle, wherein the stock material is unwindable from the roll as a flat sheet, a folding plate defining a folding plate plane that is substantially parallel with the spindle axis, the folding plate including a first edge and a second edge, wherein the first edge connects with the second edge at a central peak, first and second folding rollers positioned generally adjacent to the folding plate and being generally parallel with the folding plate plane, the first and second folding rollers defining a nip therebetween, wherein the flat sheet extends over the first edge, the second edge and the central peak and is folded between the nip to define a first folded half and a second folded half, and a spreader chute including a first guide plate and a second guide plate, the second guide plate being generally parallel with and spaced apart from the first guide plate to define a loading space therebetween, each of the first and second guide plates including an inner surface and an outer surface, wherein the first folded half is received over the inner and outer surfaces of the first guide plate, and wherein the second folded half is received over the inner and outer surfaces of the second guide plate.

In another aspect, a method for packaging an item may utilize a vertical bagging machine that may include a roll of stock material, a folding plate defining a folding plate plane and including a first edge and a second edge, wherein the first and second edges are generally equal in length and connect at an upwardly pointing central peak, a spreader chute including a first guide plate and a second guide plate, the second guide plate being substantially perpendicular to the folding plate plane and generally parallel with and spaced apart from the first guide plate, wherein each of the first and second guide plates include an inner surface and an outer surface, and first and second folding rollers defining a nip therebetween, the first and second folding rollers being generally parallel with the folding plate plane and disposed between the folding plate and the spreader chute. The method may include the steps of unwinding a sheet from the roll of stock material, passing the sheet over the first edge, the second edge and the central peak of the folding plate such that the central peak initiates a fold line in the sheet, wherein the fold line defines a partially folded sheet having a first folded half and a second folded half, passing the partially folded sheet between the nip of the first and second folding rollers such that the first folded half is opposed to the second folded half to define a folded sheet, passing the first folded half of the folded sheet over the outer surface of the first guide plate of the spreader chute while, simultaneously, passing the second folded half of the folded sheet over the outer surface of the second guide plate of the spreader chute, inverting the sheet over the first and second guide plates such that the first folded half is received over the inner and outer surfaces of the first guide plate and the second folded half is received over the inner and outer surfaces of the second guide plate, thereby defining a loading space between the first and second guide plates, positioning the item in the loading space such that the item is at least partially surrounded by the first folded half and the second folded half, and sealing the first folded half to the second folded half to enclose the item within the sheet.

Other aspects of the disclosed vertical bagging machine will become apparent from the following description, the accompanying drawings and the appended claims.

DETAILED DESCRIPTION

Figure 1:
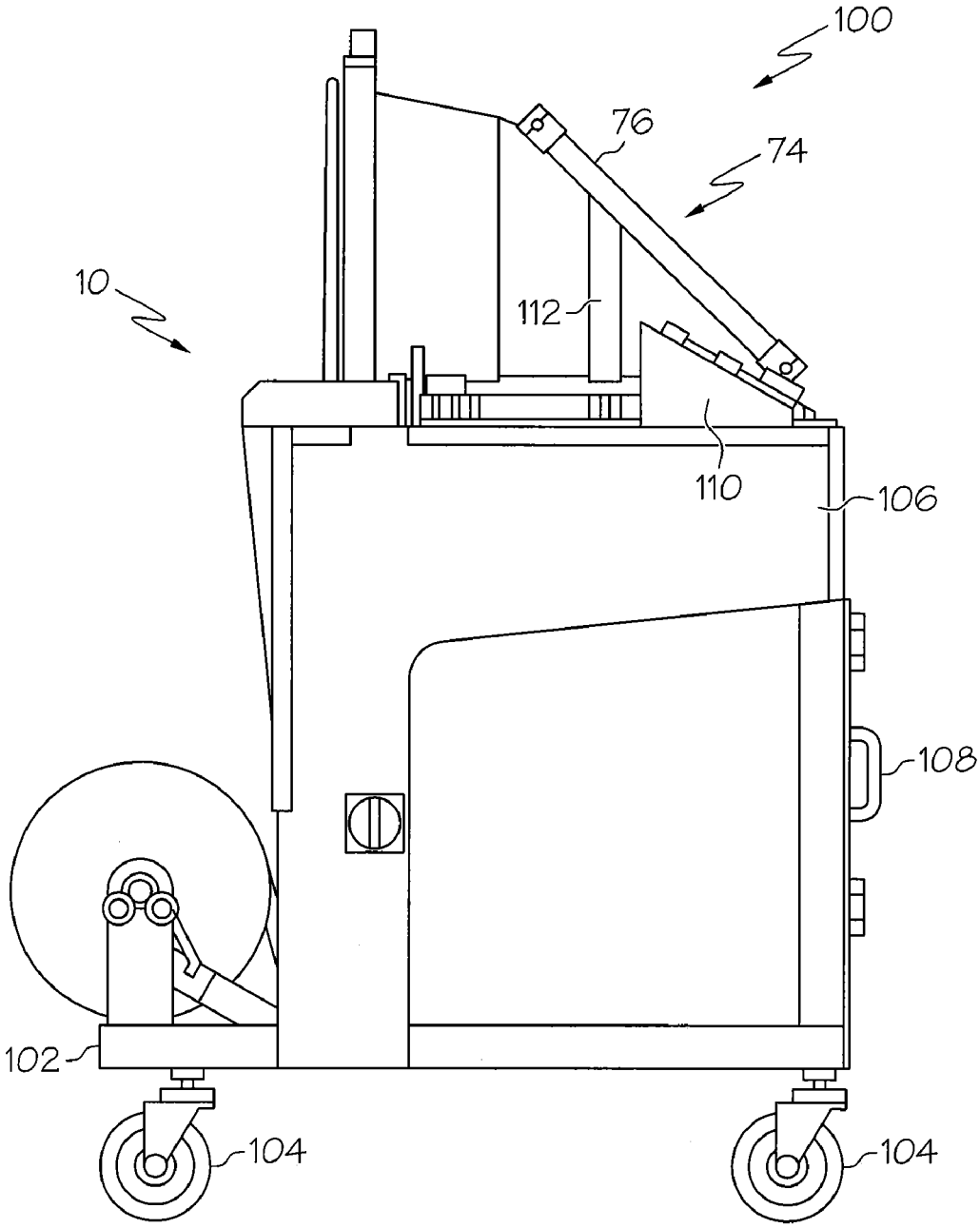
FIG. 1 is a side elevational view of one particular aspect of the disclosed vertical bagging machine.

As shown in FIG. 1, one particular aspect of the disclosed vertical bagging machine, generally designated 100, may include a vertical bagging assembly 10 (shown more fully in FIGS. 2 and 3) supported by a support structure 102. For example, the support structure may be a cart-like support structure having lockable casters 104 that may facilitate movement and positioning of the vertical bagging machine 100 in the packaging facility. However, those skilled in the art will appreciate that the support structure 102 may also be a stationary support structure without departing from the scope of the present disclosure.

Optionally, the support structure 102 may include a housing 106, such as a cabinet, in which at least a portion of the vertical bagging assembly 10 may be received. The housing 106 may include an access door 108 or the like for providing access to the components of the vertical bagging assembly 10 received in the housing 106.

A control interface 110 may be mounted on the support structure to control the operation of the vertical bagging assembly 10. For example, the control interface 110 may include an ON/OFF switch, a speed control feature, an emergency shut-off switch, a graphical user interface and the like.

Figure 2:
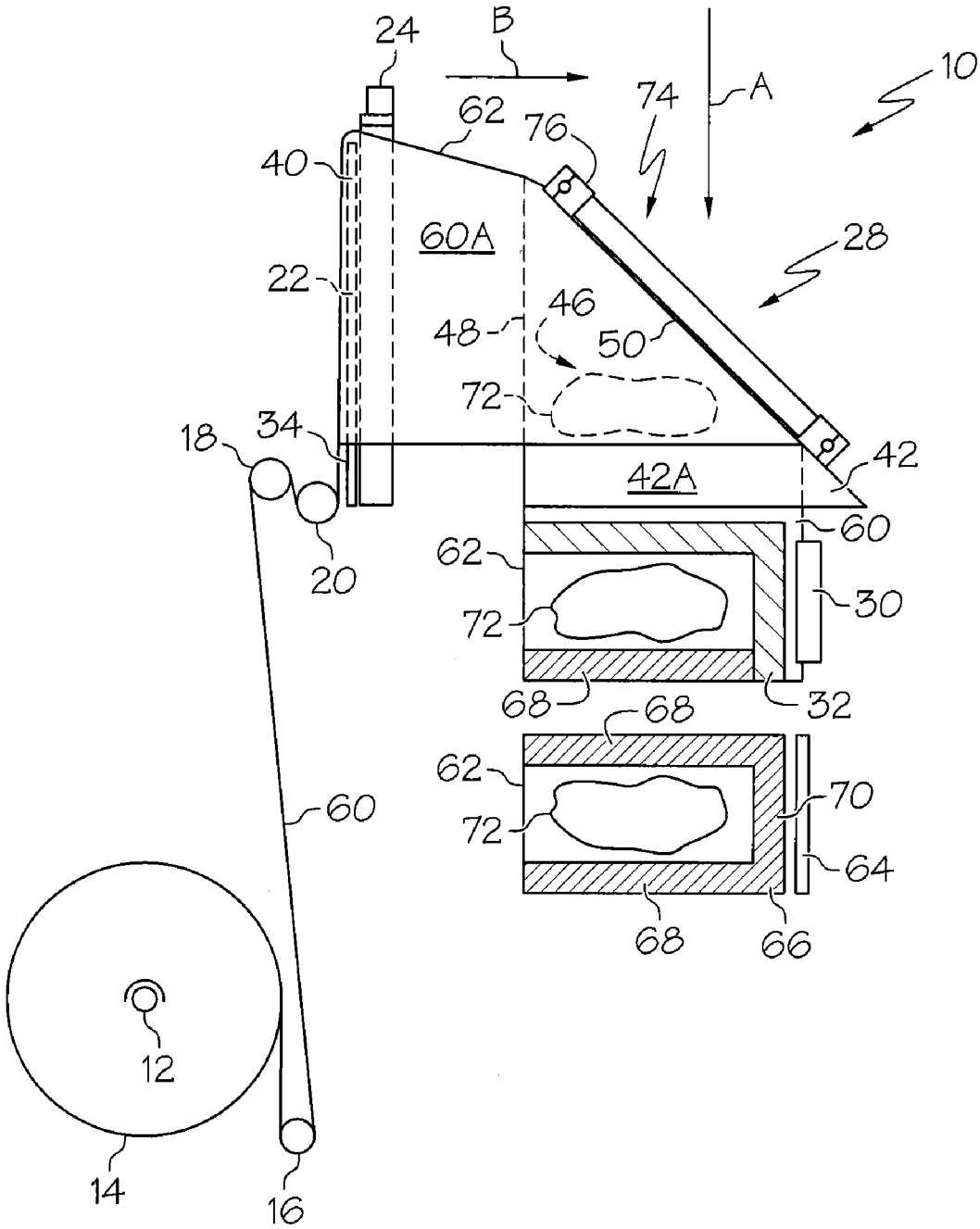
FIG. 2 is a side elevational view of the vertical bagging machine of FIG. 1, shown with the housing and support structure removed to expose internal components.
Figure 3:
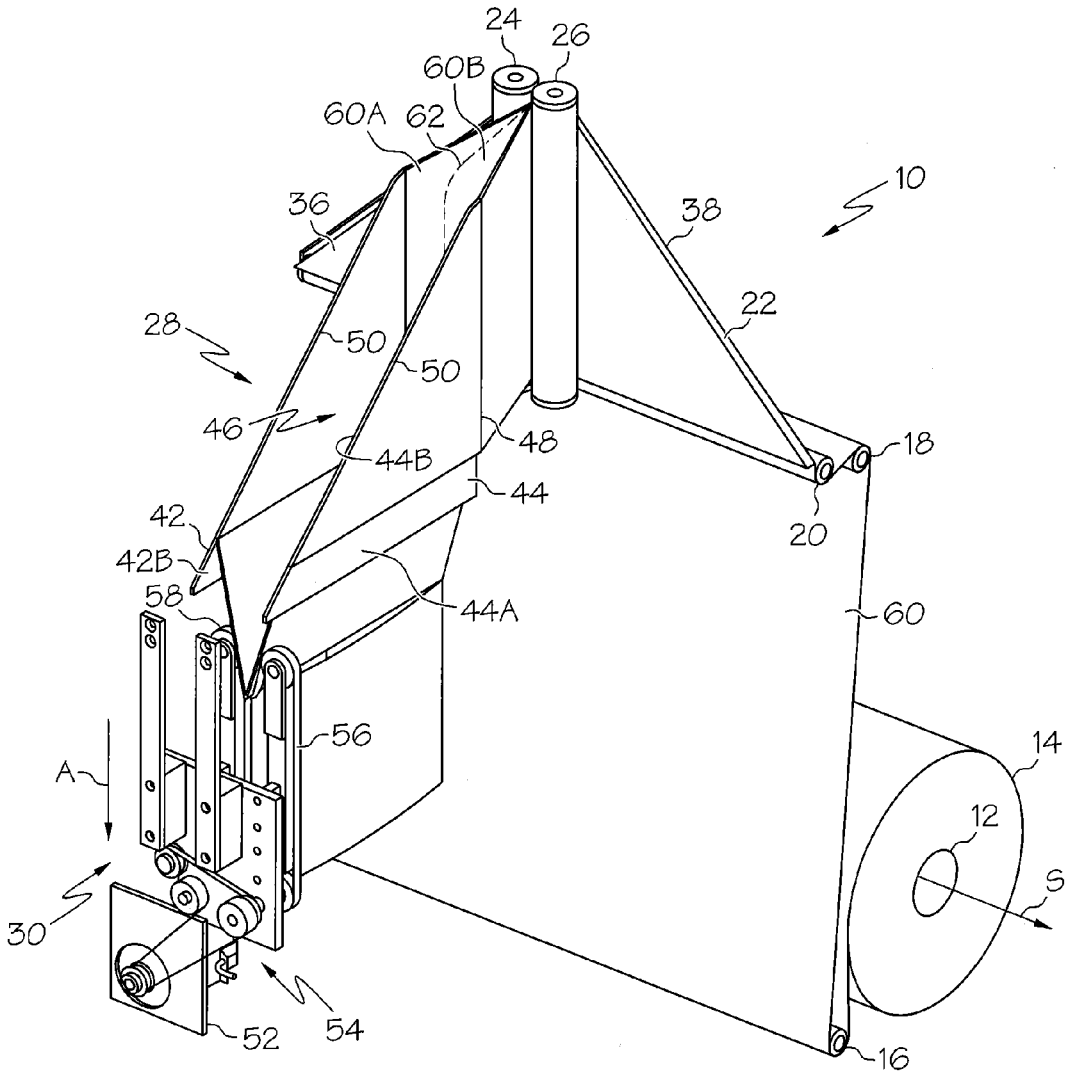
FIG. 3 is a front perspective view of the vertical bagging machine of FIG. 2.

Referring now to FIGS. 2 and 3, one particular aspect of the vertical bagging assembly 10 of the disclosed vertical bagging machine 100 may include a spindle 12 (having a spindle axis S), a roll 14 of stock material, a dancer roller 16, an outer roller 18, an inner roller 20, a folding plate 22, first and second vertical folding rollers 24, 26, an adjustable spreader chute 28, a film puller 30 (shown simply as a block in FIG. 2), and a sealing element 32 (shown only in FIG. 2). Additional rollers may be used to guide the stock material, as will be described below, without departing from the scope of the present disclosure.

The folding plate 22 may be generally planar and may include a front face 34 (FIG. 2), a first sheet-receiving edge 36 (FIG. 3) and a second sheet-receiving edge 38 (FIG. 3), wherein the first and second sheet-receiving edges 36, 38 may be generally equal in length and may meet at an upwardly pointing central peak 40 (FIG. 2) such that the folding plate 22 may be generally shaped as an isosceles triangle in front view. As shown in FIG. 1, the folding plate 22 may be connected to the support structure 102 such that the folding plate 22 is vertical and the plane of the folding plate 22 is generally parallel with the spindle axis S (shown in FIG. 3).

The first and second vertical folding rollers 24, 26 may be connected to the support structure 102 such that, as shown in FIGS. 2 and 3, the first and second vertical folding rollers 24, 26 stand vertically and parallel with the plane of the folding plate 22. Furthermore, the first and second vertical folding rollers 24, 26 may be positioned in proximity to each other to define a nip therebetween.

The adjustable spreader chute 28 may include a first guide plate 42 that is generally parallel with and spaced apart from a second guide plate 44, thereby defining a loading space 46 therebetween. The first and second guide plates 42, 44 may be secured to the support structure 102 such that the guide plates 42, 44 are generally perpendicular to the plane of the folding plate 22 and centered relative to the central peak 40. In one aspect, each guide plate 42, 44 may be generally triangular in side view (FIG. 2) and may include a rear, spreading edge 48 and an angled, film-inverting edge 50. Optionally, one or both of the guide plates 42, 44 may be articulateable relative to each other and the support structure 102 such that the width of the loading space 46 therebetween may be adjusted as necessary.

Referring to FIG. 3, the film puller 30 may include a motor 52, a pulley assembly 54, and opposed belts 56, 58. Rotational power from the motor 52 may be translated into corresponding movement of the opposed belts 56, 58 by way of the pulley assembly 54. The opposed belts 56, 58 may define a pinch point (or pinch region) therebetween that grips the sheet 60 and urges the gripped sheet 60 in the direction shown by arrow A, as will be described in greater detail below.

The roll 14 of stock material may unwind as a flat, unfolded sheet 60 and may be formed from any appropriate sheet material that may be folded and sealed, whether by heat, adhesives or otherwise, to form a bag. Optionally, the sheet 60 may be pre-printed with various text or graphics.

In one particular aspect, the sheet 60 may be a polymeric film such as polyethylene film, polypropylene film, polyvinylchloride film or the like. However, those skilled in the art will appreciate that the sheet 60 may be formed from various materials depending upon the properties desired in the end product. Furthermore, the sheet 60 may be coated with various materials and formulations to impart the sheet 60 with desired properties (e.g., moisture barriers, oxygen barriers and the like).

Referring again to FIGS. 2 and 3, the roll 14 of stock material may be received over the spindle 12 and may be centered relative to the vertical bagging assembly 10 using arbors (not shown) or the like. In one aspect, the roll 14 of stock material may be positioned on the spindle 12 such that the center line of the sheet 60 is aligned with the central peak 40 of the folding plate 22.

Once the roll 14 of sheet material has been properly aligned with the vertical bagger assembly 10, the sheet 60 may be unwound from the roll 14, passed under the dancer roller 16, then passed up and over the outer roller 18, and then passed under the inner roller 20. From the inner roller 20, the sheet 60 may then pass across the front face 34 of the folding plate 22, over the central peak 40 and the first and second edges 36, 38 of the folding plate 22, and then through the nip defined by the first and second vertical folding rollers 24, 26. As such, a downwardly open fold 62 may be initiated in the sheet 60 as the center line of the sheet 60 moves over the central peak 40 of the folding plate 22 and through the nip defined by the first and second vertical folding rollers 24, 26.

From the first and second vertical folding rollers 24, 26, the folded sheet 60 may pass to the adjustable spreader chute 28 in the direction shown by arrow B. At the adjustable spreader chute 28, a first folded half 60A of the sheet 60 may be draped over the outer surface 42A (FIG. 2) of the first guide plate 42 and a second folded half 60B of the sheet 60 may be draped over the outer surface 44A (FIG. 3) of the second guide plate 44. Then, the center of the sheet 60 (i.e., the portion of the sheet 60 adjacent to the fold line 62) may be tucked to the rear of the adjustable spreader chute 28, as shown in FIG. 3, thereby inverting the sheet 60 over the angled, film-inverting edges 50 of the first and second guide plates 42, 44, thereby redirecting the sheet 60 approximately 90 degrees (i.e., the direction that the sheet 60 travels is redirected from the direction shown by arrow B to the direction shown by arrow A). As such, the first folded half 60A of the sheet 60 is draped over both the outer surface 42A (FIG. 2) and the inner surface 42B (FIG. 3) of the first guide plate 42 and the second folded half 60B of the sheet 60 is draped over both the outer surface 44A (FIG. 3) and the inner surface 44B (FIG. 3) of the second guide plate 44.

As the redirected, folded sheet 60 moves vertically downward through the adjustable spreader chute 28 (i.e., in the direction shown by arrow A), the opposed belts 56, 58 of the film puller 30 may engage the sheet 60 and may draw the sheet 60 vertically downward through the adjustable spreader chute 28 to define the loading space 46 between the first and second guide plates 42, 44.

Referring to FIG. 2, the sealing element 32 may be positioned below the loading space 46 of the adjustable spreader chute 28 to engage the redirected, folded sheet 60 and seal the first folded half 60A of the sheet 60 to the second folded half 60B of the sheet 60. The sealing element 32 may employ heat, adhesives, fasteners or the like to form the seal. Optionally, the sealing element 32 may also include a cutting feature such that excess portions 64 of the sheet 60 may be cut away and discarded, as well as to separate individual packages 66 after sealing is complete. Those skilled in the art will appreciate that a cutting feature independent of the sealing element 32 may also be used.

In one aspect, the sealing element 32 may be an L-shaped heat sealing element. In another aspect, the sealing element 32 may include a pair of L-shaped heat sealing elements that cooperate to clamp onto and heat seal the folded sheet 60. The L-shaped heat sealing element 32 (or pair of L-shaped heat sealing elements) may form rectangular packages 66 by forming both a horizontal seal 68, which defines both upper and lower horizontal edges of the sealed package 66, and a vertical seal 70, which defines one of the two vertical edges of the sealed package 66, per sealing operation. Those skilled in the art will appreciate that the second vertical edge of the sealed package is defined by the fold 62.

Thus, an item 72 to be sealed may be positioned in the loading space 46 of the adjustable spreader chute 28, thereby surrounding the item 72 with the folded sheet 60 and leaving only two edges unsealed. (The fold 62 and the previously-formed horizontal seal may define the other two edges.) Then, as the film puller 30 draws the sheet 60 vertically downward (i.e., in the direction shown by arrow A), the item 72 is drawn downward and positioned relative to the sealing element 32 such that the sealing element 32 may seal the two previously unsealed edges, thereby forming a sealed package 66.

Still referring to FIG. 2, a light curtain 74 may be provided to detect ingress and egress into the loading space 46 of the adjustable spreader chute 28. Those skilled in the art will appreciate that the ingress and egress detected in the loading space 46 by the light curtain 74 may be a user's hand/arm depositing an item 72 (i.e., a semi-automatic process), a mechanical arm depositing an item 72, or simply the item 72 passing the light curtain 74 by, for example, the use of a loading chute (not shown) (i.e., an automatic process).

In one aspect, a controller (not shown) may prevent operation of the vertical bagging assembly 10 when the light curtain 74 is broken. In another aspect, the controller may be configured to halt operation when the light curtain 74 is broken and resume operation when the light curtain 74 in not broken, thereby automating or semi-automating the bagging process. For example, when the light curtain 74 is broken, the controller may halt all mechanical functions of the assembly 10. Then, when the controller determines that the break in the light curtain 74 is no longer present, the controller may assume that an item has been placed into the loading space 46 and, therefore, may instruct the film puller 30 to draw the sheet 60 and item 72 downward to the sealing element 32 and may instruct the sealing element 32 to perform a sealing operation. The process may repeat as the user's hand is repeatedly placed into the loading space 46 to deposit an item 72 and then removed.

The light curtain 74 may include a first light curtain element 76 positioned adjacent to the angled, film-inverting edge 50 of the first guide plate 42 and a second light curtain element (not shown) positioned adjacent to the angled, film-inverting edge 50 of the second guide plate 44. The first light curtain element 76 may cooperate with the second light curtain element to detect a break in the plane therebetween. As shown in FIG. 1, the first 76 and second light curtain elements may be connected to the support structure 102 by a bracket 112 or the like such that the light curtain 74 does not interfere with the sheet 60 as the sheet 60 moves over the first and second guide plates 42, 44.

Accordingly, in view of the present disclosure, those skilled in the art will appreciate that a vertical bagging machine may be constructed having a small footprint and easy portability that utilizes flat roll stock material (a cost savings over pre-folded stock), and which automatically (or semi-automatically) cycles with a light curtain mechanism.

Although various aspects of the disclosed vertical bagging machine have been shown and described, modifications may occur to those skilled in the art upon reading the specification. The present application contemplates and includes such modifications and is limited only by the scope of the claims.

What is claimed is:

1. A vertical bagging machine comprising:

first and second vertically extending rollers defining a nip therebetween, wherein a folded sheet of bagging material feeds out from the nip in a first configuration of the folded sheet having a first folded half, a second folded half, a horizontal fold therebetween with the first and second folded halves extending downward from the horizontal fold, a first surface of the folded sheet being an exterior surface of the first configuration, and a second surface of the folded sheet being an interior surface of the first configuration; and a spreader chute arranged to receive the folded sheet as the folded sheet emerges from the first and second rollers, wherein the spreader chute comprises a transition zone and includes a first guide plate and a second guide plate, the second guide plate being parallel with and spaced apart from the first guide plate to define a laterally accessible loading space therebetween, each of the first and the second guide plates including an inner surface and an outer surface, wherein the first folded half is received over the inner and the outer surfaces of the first guide plate, and wherein the second folded half is received over the inner and the outer surfaces of the second guide plate, wherein the first and the second guide plates invert the folded sheet from the first configuration into a second configuration in the transition zone, with the second configuration having a vertical fold, the first surface being an interior surface of the second configuration, and the second surface being an exterior surface of the second configuration.

2. The vertical bagging machine of claim 1 further comprising a film puller positioned to engage the first folded half and the second folded half to draw the first folded half and the second folded half over the first guide plate and the second guide plate respectively.

3. The vertical bagging machine of claim 1 wherein the first guide plate is moveable relative to the second guide plate.

4. The vertical bagging machine of claim 1 further comprising a sealing element.

5. The vertical bagging machine of claim 4 wherein the sealing element includes a cutting feature.

6. The vertical bagging machine of claim 4 wherein the sealing element is generally L-shaped, and wherein the sealing element is arranged such that the sealing element forms both a horizontal seal, which defines both an upper and a lower horizontal edges of a sealed package, and a vertical seal, which defines a first vertical edge of the sealed package, per sealing operation, where a second vertical edge of the sealed package is defined by the second, vertical fold.

7. The vertical bagging machine of claim 1 further comprising a light curtain, and wherein the loading space is at least partially enclosed by the light curtain.

8. The vertical bagging machine of claim 1 wherein the first and the second guide plates maintain contact with the first and second folded halves throughout the transition zone.

9. The method of claim 7 further comprising the step of separating the enclosed item from the sheet.

10. The method of claim 7 further comprising the step of defining a light curtain that at least partially encloses the loading space, wherein the feed step is performed only when the light curtain is not broken.

11. A method for packaging an item using a vertical bagging machine, the vertical bagging machine comprising first and second vertically oriented folding rollers defining a nip therebetween, a spreader chute downstream of the first and second folding rollers and including a first guide plate and a second guide plate, wherein each of the first and second guide plates include an inner surface and an outer surface, the method comprising the steps of:

feeding a folded sheet of bagging material out from the nip toward the spreader chute, the folded sheet in a first configuration having a first folded half, a second folded half and a horizontal fold therebetween, a first surface of the sheet being an exterior surface of the first configuration, and a second surface of the sheet being an interior surface of the first configuration;

as the folded sheet emerges from the first and second folding rollers, passing the first folded half of the folded sheet over the outer surface of the first guide plate of the spreader chute while, simultaneously, passing the second folded half of the folded sheet over the outer surface of the second guide plate of the spreader chute;

inverting the sheet over the first and the second guide plates such that the first folded half is received over the inner and the outer surfaces of the first guide plate and the second folded half is received over the inner and the outer surfaces of the second guide plate such that the first and second folded halves maintain contact with the first and second guide plates throughout the inverting, whereby the folded sheet having the first configuration is inverted to a second configuration having a vertical fold, the first surface being an interior surface of the second configuration, and the second surface being an exterior surface of the second configuration, thereby defining a loading space between the first and the second guide plates;

positioning the item in the loading space such that the item is at least partially surrounded by the first folded half and the second folded half; and sealing the first folded half to the second folded half to enclose the item within the sheet.

12. The method of claim 7 wherein the sealing step includes heat sealing the first folded half to the second folded half.

13. A method for packaging an item using a vertical bagging machine, the vertical bagging machine comprising a vertically oriented roller, a spreader chute downstream of the roller and including a first guide plate and a second guide plate, wherein each of the first and the second guide plates include an inner surface and an outer surface, the method comprising the steps of:

feeding a folded sheet of bagging material from the roller toward the spreader chute, the folded sheet in a first configuration having a first folded half, a second folded half and a horizontal fold therebetween, a first surface of the sheet being an exterior surface of the first configuration, and a second surface of the sheet being an interior surface of the first configuration;

as the folded sheet emerges from the roller, passing the first folded half of the folded sheet over the outer surface of the first guide plate of the spreader chute while, simultaneously, passing the second folded half of the folded sheet over the outer surface of the second guide plate of the spreader chute;

inverting the sheet over the first and the second guide plates such that the first folded half is received over the inner and the outer surfaces of the first guide plate and the second folded half is received over the inner and the outer surfaces of the second guide plate throughout the inverting, whereby the folded sheet having the first configuration is inverted to a second configuration having a vertical fold and the first folded half and second folded half extend laterally from the vertical fold, the first surface being an interior surface of the second configuration, and the second surface being an exterior surface of the second configuration, thereby defining a loading space between the first and second guide plates;

positioning the item in the loading space such that the item is at least partially surrounded by the first folded half and the second folded half; and sealing the first folded half to the second folded half to enclose the item within the sheet.

* * * * *